US008445423B2

(12) United States Patent
Bruner et al.

(10) Patent No.: US 8,445,423 B2
(45) Date of Patent: May 21, 2013

(54) CHEMICAL WIPES

(75) Inventors: Eric L. Bruner, San Diego, CA (US); Eric L. Hanson, San Diego, CA (US); Gerald W. Gruber, Englewood, FL (US)

(73) Assignee: Aculon, Inc., San Diego, CA (US)

( * ) Notice: Subject to any disclaimer, the term of this patent is extended or adjusted under 35 U.S.C. 154(b) by 121 days.

(21) Appl. No.: 12/804,166

(22) Filed: Jul. 15, 2010

(65) Prior Publication Data

US 2010/0286013 A1 Nov. 11, 2010

Related U.S. Application Data

(62) Division of application No. 11/585,458, filed on Oct. 24, 2006, now abandoned.

(60) Provisional application No. 60/729,631, filed on Oct. 24, 2005.

(51) Int. Cl.

| | |
|---|---|
| ***C11D 17/04*** | (2006.01) |
| ***C11D 3/24*** | (2006.01) |
| ***C11D 3/36*** | (2006.01) |
| ***C11D 7/28*** | (2006.01) |
| ***C11D 7/36*** | (2006.01) |

(52) U.S. Cl.
USPC ..... 510/439; 510/163; 510/164; 510/438; 510/467; 510/469

(58) Field of Classification Search
USPC ..... 510/439, 163, 164, 438, 467, 469
See application file for complete search history.

(56) References Cited

U.S. PATENT DOCUMENTS

| | | | | |
|---|---|---|---|---|
| 3,634,146 | A | 1/1972 | Wystrach et al. | 428/470 |
| 4,248,928 | A * | 2/1981 | Spadini et al. | 510/513 |
| 4,579,720 | A * | 4/1986 | Budnick | 423/10 |
| 4,795,584 | A * | 1/1989 | Ross et al. | 510/277 |
| 5,472,629 | A * | 12/1995 | Lysy et al. | 510/238 |
| 5,556,450 | A * | 9/1996 | Skodell et al. | 106/10 |
| 5,856,018 | A | 1/1999 | Chen et al. | 428/448 |
| 6,004,484 | A * | 12/1999 | Faris et al. | 252/500 |
| 6,262,009 | B1 * | 7/2001 | Rogers et al. | 510/439 |
| 6,340,663 | B1 | 1/2002 | Deleo et al. | 510/438 |
| 6,475,976 | B1 | 11/2002 | Mahieu et al. | 510/438 |
| 6,596,681 | B1 | 7/2003 | Mahieu et al. | 510/438 |
| 6,604,651 | B2 * | 8/2003 | Amundson et al. | 221/47 |
| 6,624,135 | B2 | 9/2003 | Takano | 510/438 |
| 6,645,644 | B1 | 11/2003 | Schwartz et al. | 428/632 |
| 6,645,930 | B1 | 11/2003 | Wallis et al. | 510/438 |
| 6,649,584 | B2 | 11/2003 | Wisniewski et al. | 510/438 |
| 6,716,499 | B1 | 4/2004 | Vadhar | 428/35.3 |
| 2002/0055449 | A1 * | 5/2002 | Porta et al. | 510/295 |
| 2002/0166868 | A1 * | 11/2002 | Koyama et al. | 221/47 |
| 2002/0169429 | A1 * | 11/2002 | Li et al. | 604/370 |
| 2002/0174500 | A1 * | 11/2002 | Micciche et al. | 15/104.93 |
| 2003/0138652 | A1 * | 7/2003 | Weuthen et al. | 428/511 |
| 2003/0186914 | A1 | 10/2003 | Hofer et al. | 514/44 |
| 2004/0001959 | A1 | 1/2004 | Schwartz et al. | 428/469 |
| 2004/0058604 | A1 * | 3/2004 | Jud et al. | 442/301 |
| 2005/0031910 | A1 | 2/2005 | Schwartz et al. | 428/702 |
| 2005/0079987 | A1 * | 4/2005 | Cartwright et al. | 510/296 |
| 2005/0124514 | A1 * | 6/2005 | Ospinal et al. | 510/141 |
| 2008/0064285 | A1 * | 3/2008 | Morton et al. | 442/327 |

FOREIGN PATENT DOCUMENTS

| | | | |
|---|---|---|---|
| DE | 4021336 | A1 * | 1/1991 |
| JP | 05140596 | A * | 6/1993 |
| WO | WO 02/36339 | A2 | 5/2002 |
| WO | WO 02/090484 | A2 * | 11/2002 |
| WO | WO 2004/072120 | A2 | 8/2004 |
| WO | WO 2005/084717 | A1 | 9/2005 |

* cited by examiner

*Primary Examiner* — Lorna M Douyon
(74) *Attorney, Agent, or Firm* — William J. Uhl

(57) ABSTRACT

Wipes treated with organometallic compounds used in combination with organic acids in kit form, particularly organophosphorus acid, are disclosed. The kits can be used to treat various surfaces to alter the physical properties of the surfaces.

11 Claims, No Drawings

CHEMICAL WIPES

CROSS REFERENCE TO RELATED APPLICATION

The present application is a divisional of U.S. patent application Ser. No. 11/585,458, filed Oct. 24, 2006, now abandoned, which claims priority from U.S. Provisional Patent Application Ser. No. 60/729,631, filed Oct. 24, 2005.

FIELD OF THE INVENTION

The present invention relates to chemical wipes, to the use of the wipes to treat various surfaces; to packages containing the wipes and to kits containing packages of different chemical wipes designed to be used in combination with one another on various surfaces.

BACKGROUND OF THE INVENTION

Wipes that are treated with various chemicals such as cleaning agents and bactericides are well known in the art. The wipes can be used to treat various surfaces for cleaning and to impart certain properties such as anti-bacterial protection.

It is also known that various optical surfaces such as eyewear and display devices are susceptible to dirt collection and smudging, particularly when the surfaces have an anti-reflective coating thereon. The dirt smudges may be removed or cleaned by wiping with a cloth containing a cleaning agent, but such removal is usually temporary and the surfaces are prone to repeated dirt collection and smudging which requires repeated cleaning.

Therefore, there is a need to treat such surfaces in a manner to create some permanency in the treatment such that the tendency for repeated dirt collection and smudging is reduced and/or repeated smudging can be easily removed, for example, by simply wiping with a soft cloth.

The present invention addresses this problem and provides a chemical wipe that can be used to treat optical surfaces and alter the properties of the surfaces such that the smudging problem is significantly alleviated. The wipes of the present invention can also be used to treat other surfaces where it is desired to alter the property of the surface, for example, to make the surfaces more hydrophilic or hydrophobic.

SUMMARY OF THE INVENTION

The present invention provides for the following:

A method of treating a substrate surface comprising:

(a) contacting the surface, directly or through an intermediate organometallic layer with a wipe treated with an organophosphorus acid, or derivative thereof;

(b) moving the wipe across the surface to transfer a film of the organophosphorus acid or derivative thereof to the surface or to the intermediate layer.

When the substrate surface is treated directly with the wipe, the substrate can optionally contain a hydrophobic coating that has lost its effectiveness on its surface.

A method of treating a substrate surface comprising:

(a) contacting the surface through an intermediate organometallic layer with a wipe treated with an organic acid or derivative thereof;

(b) moving the wipe across the organometallic layer to transfer a film of the organic acid or derivative thereof to the organometallic layer.

Optionally, an organic acid such as an organophosphorus acid can be applied to the organometallic layer, typically by spraying. The substrate surface can optionally contain a hydrophobic coating that has lost its effectiveness.

A package comprising a material treated with an organophosphorus acid or derivative thereof dissolved or dispersed in a diluent and in a container substantially impervious to the diluent.

A package comprising a material treated with an organometallic compound in a substantially moisture-impervious container.

A kit useful for treating a surface to alter its physical properties comprising:

(a) a package comprising a material treated with an organometallic compound in a substantially moisture-impervious container;

(b) a package comprising an organic acid or derivative thereof dissolved or dispersed in a diluent in a container substantially impervious to the diluent.

DETAILED DESCRIPTION

The wipes of the present invention typically comprise a flexible porous material usually in sheet form treated with the organometallic compound, and in one embodiment and with the organic acid, as the case may be. By the term "wipe" is meant a material treated with a substance and used to apply the substance to a surface by hand rubbing. Most often, the wipe is held by the fingers and thumb of the hand.

The material associated with the wipe is generally an absorbent or adsorbent material, for example, a woven, nonwoven or knit fabric, a foam or a sponge or other structure suitable for absorbing or adsorbing and holding the organophosphorus acid and the organometallic compound, as the case may be, and transferring by rubbing such substance to the surface being treated.

The nonwovens may include nonwoven fibrous sheet materials that include meltblown, coform, air-laid, spunbond, wet laid, bonded-carded web materials, hydroentangled (also known as spunlaced) materials, and combinations thereof. These materials can comprise synthetic or natural fibers or combinations thereof.

Woven materials, such as cotton fibers, cotton/nylon blends, or other textiles may also be used herein. Regenerated cellulose, polyurethane foams, and the like, which are used in making sponges, may also be suitable for use herein.

The organic acid that may be used to treat the wipes includes derivatives thereof. Derivatives are materials that perform similarly as the acid precursors and include acid salts such as metal salts, for example, sodium and potassium salts, acid esters such as lower alkyl esters containing from 1 to 4 carbon atoms, and acid complexes. The organo group of the acid may be a monomeric, oligomeric or polymeric group. The organic acid may be a carboxylic acid, a sulfonic acid and preferably a phosphorus acid.

Examples of monomeric carboxylic and sulfonic acids are $$R—COOR' \text{ and } R—SO_2—OR'$$

where R is a hydrocarbon or substituted hydrocarbon radical having a total of 1 to 30, preferably 6 to 20 carbon atoms and R' is H, a metal or lower alkyl. Preferably at least a portion of R' is H.

Examples of monomeric phosphoric acids are compounds or a mixture of compounds having the following structure:

$$(RO)_x—P(O)—(OR')_y$$

wherein x is 1-2, y is 1-2 and x+y=3, R preferably is a radical having a total of 1-30, preferably 6-18 carbons, where R' is H, a metal such as an alkali metal, for example, sodium or potassium or lower alkyl having 1 to 4 carbons, such as methyl or ethyl. Preferably, a portion of R' is H. The organic component of the phosphoric acid (R) can be aliphatic (e.g., alkyl having 2-20, preferably 6-18 carbon atoms) including an unsaturated carbon chain (e.g., an olefin), or can be aryl or aryl-substituted moiety.

Example of monomeric phosphonic acids are compounds or mixture of compounds having the formula:

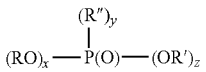

wherein x is 0-1, y is 1, z is 1-2 and x+y+z is 3. R and R" preferably are each independently a radical having a total of 1-30, preferably 6-18 carbons. R' is H, a metal, such as an alkali metal, for example, sodium or potassium or lower alkyl having 1-4 carbons such as methyl or ethyl. Preferably at least a portion of R' is H. The organic component of the phosphonic acid (R and R") can be aliphatic (e.g., alkyl having 2-20, preferably 6-18 carbon atoms) including an unsaturated carbon chain (e.g., an olefin), or can be an aryl or aryl-substituted moiety.

Example of monomeric phosphinic acids are compounds or mixture of compounds having the formula:

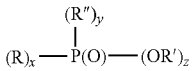

wherein x is 0-2, y is 0-2, z is 1 and x+y+z is 3. R and R" preferably are each independently radicals having a total of 1-30, preferably 6-18 carbons. R' is H, a metal, such as an alkali metal, for example, sodium or potassium or lower alkyl having 1-4 carbons, such as methyl or ethyl. Preferably a portion of R' is H. The organic component of the phosphinic acid (R, R") can be aliphatic (e.g., alkyl having 2-20, preferably 6-18 carbon atoms) including an unsaturated carbon chain (e.g., an olefin), or can be an aryl or aryl-substituted moiety.

Examples of organo groups which may comprise R and R" include long and short chain aliphatic hydrocarbons, aromatic hydrocarbons and substituted aliphatic hydrocarbons and substituted aromatic hydrocarbons. Examples of substituents include carboxyl such as carboxylic acid, hydroxyl, amino, imino, amido, thio, cyano, fluoro such as $CF_3(C_nF_{2n})CH_2CH_2PO_3H_2$ where n=3-15, $CF_3(CF_2)_xO(CF_2CF_2)_y—CH_2CH_2—PO_3H_2$ where x is 0 to 7, y is 1 to 20 and $x+y \leqq 27$, phosphonate, phosphinate, sulfonate, carbonate and mixed substituents.

Representative of the organophosphorus acids are as follows: amino trismethylene phosphonic acid, aminobenzylphosphonic acid, 3-amino propyl phosphonic acid, O-aminophenyl phosphonic acid, 4-methoxyphenyl phosphonic acid, aminophenylphosphonic acid, aminophosphonobutyric acid, aminopropylphosphonic acid, benzhydrylphosphonic acid, benzylphosphonic acid, butylphosphonic acid, carboxyethylphosphonic acid, diphenylphosphinic acid, dodecylphosphonic acid, ethylidenediphosphonic acid, heptadecylphosphonic acid, methylbenzylphosphonic acid, naphthylmethylphosphonic acid, octadecylphosphonic acid, octylphosphonic acid, pentylphosphonic acid, phenylphosphinic acid, phenylphosphonic acid, bis-(perfluoroheptyl) phosphinic acid, perfluorohexyl phosphonic acid, styrene phosphonic acid, dodecyl bis-1,12-phosphonic acid.

In addition to the monomeric organophosphorus acids, oligomeric or polymeric organophosphorus acids resulting from self-condensation of the respective monomeric acids may be used.

The organic acid is typically dissolved or dispersed in a diluent. Suitable diluents include alcohols such as methanol, ethanol or propanol; aliphatic hydrocarbons such as hexane, isooctane and decane, ethers, for example, tetrahydrofuran and dialkylethers such as diethylether. Diluents for fluorinated materials can include perfluorinated compounds such as perfluorinated tetrahydrofuran. Also, aqueous alkaline solutions such as sodium and potassium hydroxide can be used as the diluent.

Adjuvant materials may be present with the organic acid and the diluent (organic acid compositions). Examples include surface active agents, stabilizers, wetting agents and anti-static agents. The adjuvants if present are present in amounts of up to 30 percent by weight based on the non-volatile content of the organic acid composition.

The concentration of the organic acid in the composition is not particularly critical but is at least 0.01 millimolar, typically 0.01 to 100 millimolar, and more typically 0.1 to 50 millimolar. The organic acid composition can be prepared by mixing all of the components at the same time or by adding the components in several steps.

A wipe treated with the organic acid composition can be prepared by contacting the wipe with the composition by spraying or by immersion such as dipping. The time of treatment is not particularly critical and is usually from as short as 1 second to 60 minutes. The time of treatment can be varied to a significant extent, for example, by varying the concentration of the organic acid and by the number of wipes added to the treating composition. Typically, the amount of the organic acid composition contained on the wipe can range between 0.001 to 80, more typically, 0.001 to 30 percent by weight based on total weight of the treated wipe. The wipe can also be impregnated with an encapsulated organic acid. For example, the encapsulation material may be a soft polymer such as cellulose or gelatin that releases the organic acid when the wipe is moved across the surface being treated.

The treated wipe is stored or packaged in a container such as a pouch that is substantially impervious to the diluent so that the wipe does not dry out during handling and storage. The container or pouch may be made of a metal such as aluminum or a polyolefin selected from the group consisting of polyethylene, polypropylene, polybutene, poly(4-methylpentene-1), copolymers of propylene and ethylene, copolymers of ethylene and vinyl acetate, copolymers of ethylene and ethyl acrylate, and copolymers of ethylene and acrylic or methacrylic acid. The pouch typically has a thickness of from 0.5 to 15 mils.

The treated wipes can be packaged as numerous, individual sheets that are then impregnated or contacted with the organic acid composition for more economical dispensing. Also, the wipes can be formed as a continuous web during the manufacturing process and loaded into a dispenser, such as a canister with a closure, or a tub with closure. The closure is to seal the treated wipes from the external environment and to prevent premature volatilization of the diluent. The dispenser may be formed of a metal such as aluminum, a polymer, such as high density polyethylene, polypropylene, polycarbonate, polyethylene terephthalate (PET), polyvinyl chloride (PVC), or other rigid polymers. The continuous web of wipes could preferably be threaded through a thin opening in the top of the dispenser, most preferably, through the closure. A means of sizing the desired length or size of the wipe from the web would then be needed. A knife blade, serrated edge, or other means of cutting the web to desired size can be provided on the top of the dispenser, for non-limiting example, with the thin opening actually doubling in duty as a cutting edge. Alternatively, the continuous web of wipes could be scored, folded, segmented, or partially cut into uniform or non-uniform sizes or lengths, which would then obviate the need for a sharp cutting edge. Further, as in hand tissues, the wipes could be interleaved, so that the removal of one wipe advances the next, and so forth. The treated wipe can also be used in the form of a "marker" in which the container holding the organic acid composition contains a felt tip that is in contact with the organic acid. As the felt tip is moved across the surface to be treated, it distributes the organic acid composition to the surface.

In another embodiment, the organic acid could be stored in a spray bottle and sprayed onto the surface to be treated, for example, onto an organometallic film deposited as described below. Optionally, a wipe could then be moved across the surface to distribute the organic acid. Alternatively, after the organic acid composition is sprayed onto the surface, the diluent could simply be allowed to evaporate. For spray applications, the organic acid composition can be stored in a bottle or container made from a metal such as aluminum or the polymeric materials as described above.

The organometallic compound is preferably derived from a metal or metalloid, preferably a transition metal, selected from Group III and Groups IIIB, IVB, VB and VIB of the Periodic Table. Transition metals are preferred, such as those selected from Groups IIIB, IVB, VB and VIB of the Periodic Table. Examples are tantalum, titanium and zirconium. The organo portion of the organometallic compound is selected from those groups that are reactive with the acids (or their derivatives) of the organic acid as it is believed that the organometallic compound promotes adhesion of the organic acid to the surface being treated. Also, as will be described later, the organo group of the organometallic compound is believed to be reactive with groups on the surfaces being treated such as oxide and hydroxyl groups. Examples of suitable organo groups of the organometallic compound are alkoxide groups containing from 1 to 18, preferably 2 to 4 carbon atoms, such as ethoxide, propoxide, isopropoxide, butoxide, isobutoxide, tert-butoxide and ethylhexyloxide. Mixed groups such as alkoxide, acetyl acetonate and chloride groups can be used.

With regard to the preferred metals titanium and zirconium, the organic titanates and zirconates ranging from very reactive simple esters and polymeric forms of esters to stabilized chelated forms, these include a. alkyl ortho esters of titanium and zirconium having the general formula $M(OR)_4$, wherein M is selected from Ti and Zr and R is $C_{1-18}$ alkyl, b. polymeric alkyl titanates and zirconates obtainable by condensation of the alkyl ortho esters of (a), i.e., partially hydrolyzed alkyl ortho esters of the general formula $RO[-M(OR)_2O-]_{x-1}R$, wherein M and R are as above and x is a positive integer, c. titanium chelates, derived from ortho titanic acid and polyfunctional alcohols containing one or more additional hydroxyl, keto, carboxyl or amino groups capable of donating electrons to titanium. These chelates have the general formula $$Ti(O)_a(OH)_b(OR')_c(XY)_d$$

wherein a=4-b-c-d; b=4-a-c-d; c=4-a-b-d; d=4-a-b-c; R' is H, R as above or X—Y, wherein X is an electron donating group such as oxygen or nitrogen and Y is an aliphatic radical having a two or three carbon atom chain such as i. $-CH_2CH_2-$, e.g., of ethanolamine, diethanolamine and triethanolamine,

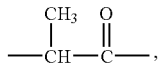

ii. e.g., of lactic acid,

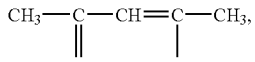

iii. e.g., of acetylacetone enol form, and

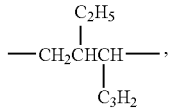

iv. e.g., as in 1,3-octyleneglycol, d. titanium acylates having the general formula $Ti(OCOR)_{4-n}(OR)_n$ wherein R is $C_{1-18}$ alkyl as above and n is an integer of from 1 to 3, and polymeric forms thereof, e. mixtures thereof.

The organometallic compound is usually dissolved or dispersed in a diluent. Examples of suitable diluents are alcohols such as methanol, ethanol and propanol, aliphatic hydrocarbons, such as hexane, isooctane and decane, ethers, for example, tetrahydrofuran and dialkylethers and diethylether.

Also, adjuvant materials may be present with the organometallic compound and the diluent (organometallic compositions). Examples include stabilizers such as sterically hindered alcohols, surfactants and anti-static agents. The adjuvants if present are present in amounts of up to 30 percent by weight based on the non-volatile content of the composition.

The concentration of the organometallic compound in the composition is not particularly critical but is usually at least 0.01 millimolar, typically from 0.01 to 100 millimolar, and more typically from 0.1 to 50 millimolar.

The organometallic treating composition can be obtained by mixing all of the components at the same time or by combining the ingredients in several steps. Since the organometallic compound is reactive with moisture, care should be taken that moisture is not introduced with the diluent or adjuvant materials and that mixing is conducted in a substantially anhydrous atmosphere.

The wipes are treated with the organometallic composition generally as described above for the organic acid treatment. The content of the organometallic compound contained in the wipe is typically the amount described above for the organic acid.

The wipe treated with the organometallic compound is stored or packaged in a container such as substantially described above for the organic acid and that is substantially impervious to moisture and to the diluent associated with the organometallic compound. Examples of suitable container materials are those described above in connection with the organic acid. Polymeric materials are preferably used in combination with metallized foils. These containers are laminates comprising outer layers of the polymers mentioned above in connection with the containers for the organic acid compositions but with the core layer of a metallized film such as aluminum applied by vacuum deposition on a polyethylene terephthalate film. The thickness of the laminates is usually from about 3 to 15 mils.

The organic acid package and the organometallic package are typically provided as a kit with one container containing the organic acid composition and the second container containing the organometallic composition. The end user would then remove the treated wipes from the containers and treat the desired surface. In the embodiment in which the organic acid is in a spray bottle, the organic acid would be sprayed onto the desired surface.

Examples of suitable surfaces or substrates to be treated in accordance with the present invention are metals such as tantalum, aluminum, copper, titanium and iron, and alloys of metals such as steel and brass; metalloids such as silicon and germanium, ceramic materials such as glass and polymer materials such as polycarbonates. Preferably, the substrate is one that contains surface hydroxyls or oxide groups such as the native oxide layers associated with most metals and their alloys. Native oxide layers of metalloids such as silicon are also appropriate. Ceramic materials and polymers that inherently have reactive groups such as carboxyl or hydroxyl groups may also be used. For example, polymeric substrates may have reactive functional groups. Examples are polymers that contain hydroxyl groups such as acrylic polymers made from one or more monomers that contain hydroxyl groups. Also, composite inorganic/organic polymers such as organic polymers containing entrained silica and alumina may be used. Also, polymer surfaces may be oxidized by subjecting them to atmospheric plasma treatment in the presence of air. In the case where substrates do not have reactive groups, they may be modified. For example, a metal oxide layer may be applied to a glass or polymer substrate by sputtering, or a silicon oxide overlayer may be provided by applying a sol-gel to the substrate. Indium tin oxide is a metal oxide preferred for electrical end use applications and may be applied by sputtering. Also, metal oxides can be deposited on polymer substrates, for example, "stacked" metal oxides on polymer substrates to provide anti-reflective properties.

A particularly preferred surface is an optical or electrooptical surface such as those associated with eyewear, camera lenses and display devices such as those associated with light-emitting diodes including organic light-emitting diodes, polymer light-emitting diodes, liquid crystals and plasma screens. An anti-reflective layer may optionally be on the surface of these substrates.

The substrate or surface is typically treated by first contacting the surface of the substrate with the organometallic wipe and then with the organic acid. Treatment is typically at ambient or elevated temperature (20-200° C.) depending on the reactivity of the organometallic composition and the organic acid. The wipe(s) are moved across the surface of the substrate to transfer a film of the organometallic composition and/or the organic acid composition, as the case may be, to the surface of the substrate. The film on initial application will have a "wet look" due to the presence of the diluent. When the diluent evaporates, a film of the compound remains. The resulting films are durable in that they are not readily removed by rubbing with a cloth. The organic acid film is resistant to dirt collection and smudging and dirt and smudges are easily removed by light rubbing with a soft cloth.

Although not intending to be bound by any theory, in the case of the organophosphorus wipe, it is believed the acid group associates or bonds with the oxide or hydroxyl groups on the surface of the substrate being treated, resulting in a durable film. The organophosphorus acid self-assembles with the organo group being oriented out and away from the surface of the substrate and alters the properties of the surface. For example, a perfluorodecyl group makes the surface more hydrophobic and resistant to moisture penetration. The dodecyl group would make the surface more lubricious and resistant to dirt collection. A polar group, such as a hydroxy lower alkyl group, would make the surface more hydrophilic and possibly easier to clean.

It has been found that the organophosphorus acid wipe, particularly fluoro-substituted organophosphorus acid wipes, can also be used in the form of a repair kit to treat a surface that has a hydrophobic coating, for example, an organosilicon or organofluoro anti-smudge coating different from the organophosphorus acid. Such coatings lose their effectiveness with time. Surprisingly, treatment with the organophosphorus wipes of the present invention can revive the hydrophobicity of the surface being treated and provides a surprisingly durable coating. Also, the organophosphorus wipes and the organometallic wipes can be used in the form of a two-component repair kit in which the organometallic wipe is first used to treat a surface having a failed hydrophobic coating followed by treating with the organophosphorus wipe.

Once again, not intending to be bound by any theory, it is believed in the case of the organometallic composition, the alkoxide groups of the metal alkoxide strongly bond to the surface of the oxide and/or hydroxyl groups and to the acid groups of the organic acid at lower temperatures than when the organophosphorus acid is used alone. Also, with other organic acids, such as carboxylic and sulfonic, the intermediate organometallic layer is needed to secure the organic acid to the substrate. The bonding between the alkoxide groups and the oxide and/or hydroxyl groups and the acid groups are believed to be stronger than the bonds between the surface oxide and/or hydroxyl groups and the acid groups. This results in a more durable composite film.

EXAMPLES

The following examples are intended to illustrate the invention, and should not be construed as limiting the invention as many different embodiments can be made without departing from the spirit and scope of the invention. Therefore, the invention is not limited except as defined in the claims.

Example 1

A cotton wipe impregnated with 20 mM titanium tetra-n-butoxide in dodecane was wiped across the surface of a 4"×4" anti-reflective film (indium tin oxide/$SiO_2$ stacked oxide on polycarbonate film) for 10 seconds. This resulted in a thin solvent film that evaporated leaving behind a partially hydrolyzed film of $[Ti(O)_x(OH)_y(\text{n-butoxy})_z]_n$, where x=4-y-z, y=4-x-z, z=4-y-x, and n is from 2-1000. This surface coating was then 'activated' by wiping (for 10 seconds) the surface with a cotton wipe impregnated with a 2 mM solution of 1H,2H,2H'-perfluorododecyl-1-phosphonic acid in ethanol. Any residue or solvent left on the surface was removed by wiping the surface with a clean, dry cloth. The contact angle of the antireflective surface increased from ~15 degrees (untreated) to ~118 degrees (after treatment). The surface became resistant to smudging, and dirt/smudge removal was far easier on the treated (hydrophobized) surface. The hydrophobicity of the coating could be easily regenerated (if damaged by excessive scratching, etc.) by reapplying the perfluorophosphonic acid solution.

Example 2

A 0.2 percent by weight solution of poly(hexafluoropropylene)phosphonic acid (PHFPOPA) having a weight average molecular weight of about 1582 in the perfluorinated solvent HFE-7100 from the 3M Company was prepared and used to impregnate a tissue in the form of a hand wipe. The impregnated tissue was wiped across the surface of a polycarbonate plano lens blank. The solvent was permitted to evaporate resulting in a hydrophobic coating having a water contact angle reported in Table I below. Table I also reports on the durability of the coating as determined by the decrease in water contact angle after rubbing with a microfiber cloth. The coating was considered to fail if the contact angle dropped below 95°.

Example 3

A tissue in the form of a hand wipe was impregnated with a solution of 0.25 percent by weight titanium tetra n-butoxide in petroleum distillates (100-140° C. boiling range) and wiped (for about 3 seconds) across the surface of a polycarbonate plano lens blank that has a polysiloxane anti-scratch coating (hard coat). The solvent evaporates as the hand wipe is moved across the surface of the lens and the organometallic compound is transferred to the surface. A second tissue in the form of a hand wipe was impregnated with the PHFPOPA solution of Example 2 and wiped (for about 3 seconds) across the surface of the previously applied organometallic coating. Again the solvent evaporates as the hand wipe is moved across the surface and the organophosphorus compound is transferred to the organometallic surface. The water contact angle and the durability of the coating are reported in Table I below.

Example 4

The procedure of Example 3 is repeated with the exception that the PHFPOPA solution was sprayed (finger pump sprayer) onto the organometallic coating. Excess solvent was allowed to evaporate and the residue was removed by gently rubbing with a microfiber cloth. The water contact angle and durability is reported in Table I below.

TABLE I

Water Contact Angle and Coating Durability

| Example No. | Initial Contact Angle[1] | Contact Angle After 10 cycles[2] | 20 cycles[2] | 30 cycles[2] | 50 cycles[2] |
|---|---|---|---|---|---|
| 2 | 112 | 108 | 106 | 107 | 106 |
| 3 | 115 | 114 | 111 | 102 | 93 |
| 4 | 115 | 114 | 112 | 108 | 100 |

[1]Water contact angle determined with a Goniometer TANTEC Contact Angle Meter, Model CAM-MICRO.
[2]Rubbing with a microfiber cloth with a force of 150 grams/cm$^2$. One cycle is a rub back and forth.

Example 5

A Sola Teflon Easycare (anti-reflective/anti-smudge coating) on a polycarbonate ophthalmic lens was abraded with steel wool at a pressure of 150 grams/cm$^2$ and the decrease in water contact angle versus the number of rubs was noted. When the water contact angle dropped below 95°, the coating was no longer considered hydrophobic and the coating failed. The lens was then sprayed and then wiped with a tissue in the form of a hand wipe with a solution of 0.05 percent by weight PHFPOPA in a mixture of 89 percent by volume isooctane, 5 percent HFE-7100, 5 percent isopropanol and 1 percent of a fragrance (Repair Kit). The solvent evaporates as the solution is wiped across the surface and the PHFPOPA is transferred to the surface. The hydrophobic properties of the coating and its durability as determined with continued abrasion with steel wool is reported in Table II below.

Example 6

The procedure of Example 5 was repeated except the lens was a polycarbonate material coated with Essilor Crizal Alize anti-reflective/anti-smudge coating. The hydrophobic properties of the Repair Kit Coating and its durability are reported in Table II below.

Example 7

The procedure of Example 5 was repeated except that the lens was an INDO natural ultrafin "self-cleaning" ophthalmic lens. The hydrophobic properties of the Repair Kit Coating and its durability are reported in Table II below.

Example 8

A polycarbonate ophthalmic lens coated with a Zeiss anti-reflective layer was wiped as generally described in Example 2 with a tissue impregnated with a 0.2 percent by weight solution of PHFPOPA in 75 percent by volume HFE-7100/25 percent by volume acetone. The coated lense was aabraded as described in Example 5. When the water contact angle dropped below 95°, the abraded surface was then treated with a tissue impregnated with the PHFPPA solution as described immediately above. The solvent evaporates as the hand wipe is passed over the abraded surface and the PHFPOPA is transferred to the surface. The hydrophobic properties of repair kit coating and its durability is reported in Table II below.

TABLE II

Water Contact Angle and Coating Durability

| Example No. | Initial Water Contact Angle[1] | Contact Angle after Cycles 250[2] | 500[2] | 1000[2] | Apply Repair Kit. Initial Contact Angle | Contact Angle after Cycles 250[2] | 500[2] |
|---|---|---|---|---|---|---|---|
| 5 | 115 | 108 | 105 | 95 | 115 | 110 | 103 |
| 6 | 113 | 110 | 103 | 80 | 116 | 108 | 106 |
| 7 | 106 | 80 | — | — | 116 | 109 | 100 |
| 8 | 116 | 113 | 108 | 95 | 114 | 112 | 105 |

[1]Water contact angle determined as in Table I.
[2]Rubbing with steel wool with a force of 150 grams/cm$^2$. One cycle is a rub back and forth.

The invention claimed is:

1. A package comprising a sheet material impregnated with an organophosphonic acid having the following structure:

$$CF_3(CF_2)_xO(CF_2CF_2)_y—CH_2CH_2—PO_3H_2$$

where x is 0 to 7, y is 1 to 20 and $x+y \leqq 27$, or derivative thereof selected from acid salts and acid esters, dissolved or dispersed in a liquid diluent, in a container substantially impervious to the diluent contained in the sheet material.

2. The package of claim 1 in which the material is a flexible porous sheet.

3. The package of claim 2 in which the flexible porous sheet is in the form of a hand wipe.

4. The package of claim 2 in which the flexible porous sheet is made of a woven or non-woven material.

5. The package of claim 1 in which the organophosphonic acid-treated material is prepared from the organophosphonic acid or derivative thereof having a concentration of 0.01 to 100.0 millimolar in the diluent.

6. The package of claim 1 in which the organophosphonic acid or derivative thereof comprises 0.001 to 30 percent by weight of the treated material based on total weight of the treated material.

7. The package of claim 1 in which the container is a plastic pouch.

8. The package of claim 1 in which the container comprises an olefin polymer or copolymer.

9. The package of claim 8 in which the olefin polymer or copolymer is selected from an ethylene polymer, a propylene polymer or an ethylene-propylene copolymer.

10. The package of claim 1 in which the container comprises alternating layers of an olefin polymer or copolymer and a metallized film.

11. The package of claim 1 in which the container has a thickness of 0.5 to 15 mils.

* * * * *

UNITED STATES PATENT AND TRADEMARK OFFICE

CERTIFICATE OF CORRECTION

PATENT NO. : 8,445,423 B2
APPLICATION NO. : 12/804166
DATED : May 21, 2013
INVENTOR(S) : Eric L. Bruner et al.

It is certified that error appears in the above-identified patent and that said Letters Patent is hereby corrected as shown below:

In the Claims

Col. 10, line 58, the symbol "≦" before the numeral 27 should read -- ≤ --

Signed and Sealed this
Sixteenth Day of July, 2013

Teresa Stanek Rea
*Acting Director of the United States Patent and Trademark Office*